US005958832A

United States Patent [19]

Uemura et al.

[11] Patent Number: 5,958,832

[45] Date of Patent: Sep. 28, 1999

[54] SUBLIMATION THERMAL TRANSFER RECORDING METHOD AND RECORDING MATERIAL THEREFOR

[75] Inventors: Hiroyuki Uemura, Mishima; Chiharu Nogawa, Numazu; Hiroki Kuboyama, Mishima, all of Japan

[73] Assignee: Ricoh Co., Ltd., Tokyo, Japan

[21] Appl. No.: 08/734,853

[22] Filed: Oct. 23, 1996

[30] Foreign Application Priority Data

Oct. 26, 1995 [JP] Japan ..... 7-279513
Oct. 18, 1996 [JP] Japan ..... 8-297640

[51] Int. Cl.[6] ..... B41M 5/035; B41M 5/38

[52] U.S. Cl. ..... 503/227; 428/195; 428/423.1; 428/447; 428/474.4; 428/488.4; 428/913; 428/914

[58] Field of Search ..... 8/471; 428/195, 428/488.4, 913, 914, 423.1, 447, 474.4; 503/227, 201

[56] References Cited

U.S. PATENT DOCUMENTS 4,720,480 1/1988 Ito et al. ..... 503/227
5,348,931 9/1994 Mochizuki et al. ..... 503/227
5,376,619 12/1994 Mochizuki et al. ..... 503/227
5,494,884 2/1996 Kobayashi et al. ..... 503/227
5,525,573 6/1996 Uemura et al. ..... 503/227
5,565,404 10/1996 Mochizuki et al. ..... 503/227
5,597,774 1/1997 Uemura et al. ..... 503/227

FOREIGN PATENT DOCUMENTS 4-126294 4/1992 Japan ..... 503/227

*Primary Examiner*—Bruce H. Hess
*Attorney, Agent, or Firm*—Oblon, Spivak, McClelland, Maier & Neustadt, P.C.

[57] ABSTRACT

A sublimation thermal transfer recording material including a smooth and excellent heat resistant layer which has excellent feeding property and excellent image qualities even when used for n-fold speed mode multiple sublimation thermal transfer recording. The sublimation thermal transfer recording material comprises a substrate, an ink layer formed thereon and a heat resistant layer formed on the non-layered side of the substrate, wherein the heat resistant layer has a softening point of at least 200° C. which is measured by a method based on JIS-K7196.

22 Claims, 1 Drawing Sheet

SUBLIMATION THERMAL TRANSFER RECORDING METHOD AND RECORDING MATERIAL THEREFOR

BACKGROUND OF THE INVENTION

1. Field of the Invention

The present invention relates to a sublimation thermal transfer recording method and a recording material useful for thermal printers, copying machines, facsimiles and the like.

2. Discussion of Background

Recently, the demand for full color printing is increasing year by year. There have been known various recording methods for full color printing including electrophotographic recording methods, ink jet recording methods and thermal transfer recording methods. Among these methods, the thermal transfer recording methods are widely employed because of advantages such as good image quality, high speed printing, and easy operation and maintenance.

The thermal transfer recording methods can be broadly classified into two types, a thermofusing thermal transfer recording and a sublimation thermal transfer recording.

In the thermofusing thermal transfer recording, an image can be obtained on an image receiving material upon application of heat to the backside of a thermofusing thermal transfer recording material whose ink layer contacts the image receiving material. The thermofusing thermal transfer recording material comprises a substrate such as polyester film, and an ink layer which is formed on the substrate and includes a coloring agent dispersed in a thermofusible material. When the thermal transfer recording material is subjected to the application of heat, the ink layer melts and transfers to the image receiving material, so that an image is formed on the receiving material.

Similarly, in the sublimation thermal transfer recording, an image can be obtained on an image receiving material upon application of heat to the backside of a sublimation thermal transfer recording material whose ink layer contacts a dye receiving layer of the image receiving material. The sublimation thermal transfer recording material comprises a substrate and an ink layer which is formed on the substrate and includes a thermo-diffusional dye (hereinafter referred to as a sublimable dye) dispersed in a binder resin. When the sublimation thermal transfer recording material is subjected to the application of heat, the sublimable dye diffuses into the dye receiving layer of the image receiving material, so that an image is formed on the image receiving material.

When these two recording methods are compared for full color printing, the sublimation thermal transfer recording is superior to the thermofusing thermal transfer recording with respect to fidelity of color tone and half tone and resolution of the printed image. The image formed by the sublimation thermal transfer recording has excellent image qualities as good as photographic images.

However, the sublimation thermal transfer recording method costs more to run than these other methods, because:

(a) a sublimable dye is relatively expensive;

(b) yellow, magenta, cyan, and, when necessary, black image transfer recording materials, each individually being of equal size to the recorded image, are needed to obtain a full color image; and (c) a used sublimation thermal transfer recording material must be disposed of even though there is a large unused part of the recorded sheet.

To obviate this shortcoming, so-called multiple sublimation thermal transfer recording methods have been proposed.

The multiple sublimation thermal transfer recording methods include the n-times (n is at least 2) mode multiple recording method and the n-fold (n is at least 2 and is generally from 5 to 20) speed mode multiple recording method.

In the n-times mode multiple recording method, a sublimation thermal transfer recording material is repeatedly printed n-times under the condition of the same feeding speed as the image receiving material.

In the n-fold speed mode multiple recording method by contrast, a sublimation thermal transfer recording material is printed under the condition of the feeding speed of 1/n to the image receiving material.

The image printed by the n-fold speed mode multiple recording method is superior to an image printed by the n-times mode multiple recording method because of advantages such as satisfactory evenness of the printed image and no wrinkling of the recording material in printing.

In general, thermal transfer recording materials, particularly sublimation thermal transfer recording materials (hereinafter referred to as recording sheets) have a heat resistant layer which includes a heat resistant resin and is formed on the opposite side of an ink layer to prevent the recording material from sticking to a thermal printhead which is a popular printing medium of thermal printing apparatus.

A variety of heat resistant layers have been proposed for thermal transfer recording materials. For example, a heat resistant layer including a heat resistant resin (Japanese Laid-Open Patent Application No. 55-7467), a heat resistant layer including a heat resistant filler to decrease friction force between a recording material and a thermal printhead (Japanese Laid-Open Patent Application No. 56-155794), and a heat resistant layer including a reaction product of polyvinylbutyral and an isocyanate, and a lubricant such as, an alkali metal salt of a phosphoric acid ester (Japanese Laid-Open Patent Application No. 61-14992), are proposed. Japanese Laid-Open Patent Applications Nos. 63-145088 and 3-65396 propose a heat resistant layer including a binder resin and a spherical filler to decrease contacting areas of the recording material to a thermal printhead.

Recently, as the demand for the sublimation thermal transfer recording continues to grow for high speed recording and/or high-n-fold speed mode multiple recording, the sublimation thermal transfer recording materials are required to be more heat resistant than before because the recording materials receive relatively high printing heat.

Therefore, such conventional heat resistant layers that include only a heat resistant resin cannot be employed for these purposes because the recording material sticks to a thermal printhead (hereinafter sticking), resulting in misfeeding and breakage of the recording materials and occurrence of uneven printed images.

When a heat resistant layer including a filler is used and the diameter of the filler becomes too small, the heat resistant layer cannot prevent sticking because the contacting areas of the heat resistant layer to a thermal printhead cannot be decreased. On the other hand, when the diameter of a filler is large enough to prevent sticking, another problem occurs such that undesirable white spots appear in a printed image, particularly in a half tone image. The reason for the problem is that the heat energy received by the ink layer near the large particles of the filler in the heat resistant layer is not enough to form an image because of the insufficient contact between the heat resistant layer near the large particles of the filler and the thermal printhead. In the n-fold speed mode multiple recording, the length of the white spots are magnified n-times in the feeding direction of the receiving material, so that the image quality is seriously deteriorated.

In the n-fold speed mode multiple recording, since the recording material runs more slowly than in normal sublimation thermal transfer recording (n=1), the recording material receives relatively high printing heat. Therefore, the recording material used in the n-fold speed mode multiple recording is required to have excellent heat resistance.

In addition, in the n-fold speed mode multiple recording, since the recording material and the image receiving material are run at different speed in printing, a strong friction force occurs between the recording material and the image receiving material, so that problems such as, sticking, and thus, uneven printed images resulting therefrom, tend to occur more frequently than normal sublimation thermal transfer recording.

Further, when using a crosslinkable resin in a heat resistant layer to improve heat resistance property, problems occur such as instability of heat resistance property caused by uneven crosslinking of the heat resistant layer and gelation of the coating liquid during the coating process of the heat resistant layer.

Because of these reasons, a need exists for a sublimation thermal transfer recording method and a recording material therefor in which a printed image has excellent image qualities without uneven image caused by sticking and undesirable white spot images even when used for an n-fold speed mode multiple recording.

SUMMARY OF THE INVENTION

Accordingly, one object of the present invention is to provide a sublimation thermal transfer recording material which has excellent feeding property, excellent image qualities without uneven image caused by sticking and undesirable white spot images.

Another object of the present invention is to provide a sublimation thermal transfer recording material having a uniform heat resistant layer which has relatively high heat resistance and low coefficient of friction, and smooth surface which is sufficient to permit use for n-fold speed mode multiple sublimation thermal transfer recording as well as normal sublimation thermal transfer recording.

To achieve such objects of the present invention, the present invention is directed to a sublimation thermal transfer recording material which includes a substrate, an ink layer formed on one side of the substrate, and a heat resistant layer which is formed on the other side of the substrate, wherein the heat resistant layer has a softening point of at least 200° C. measured by a method based on JIS-K7196.

In an embodiment of the present invention, an n-fold speed mode multiple sublimation thermal transfer recording method is provided wherein the above-mentioned sublimation thermal transfer recording material forms an image on an image receiving material whose feeding speed is equal or faster than that of the sublimation thermal transfer recording material.

In another embodiment of the present invention, the heat resistant, layer includes a silicone modified resin.

In a yet another embodiment of the present invention, the silicone modified resin includes a reaction product of silicone-grafted polymer and an isocyanate compound.

In a further embodiment of the present invention, the isocyanate compound includes a trimer of tolylene diisocyanate.

In a still further embodiment of the present invention, the substrate includes an aromatic polyamide film.

These and other objects, features and advantages of the present invention will become apparent upon a consideration of the following description of the preferred embodiments of the present invention taken in conjunction with the accompanying drawings.

DESCRIPTION OF THE PREFERRED EMBODIMENTS

The present invention provides an improved sublimation thermal transfer recording material having excellent feeding property and image qualities even when used for n-fold speed mode multiple sublimation thermal transfer recording.

The sublimation thermal transfer recording material of the present invention includes a substrate, an ink layer formed on one side of the substrate and a heat resistant layer which is formed on the other side of the substrate, wherein the heat resistant layer has a softening point of at least 200° C. measured by a method based on JIS-K7196.

The heat resistant layer of the recording material of the present invention has excellent heat resistance and lubricating property, so that an excellent image can be obtained even by an n-fold speed mode multiple sublimation recording method.

The heat resistant layer preferably includes a crosslinked silicone-grafted resin, and more preferably includes a crosslinked silicone-grafted resin by an isocyanate compound which is preferably a trimer of tolylene diisocyanate.

These preferable heat resistant layers generate very little or no residue on a thermal printhead, which is a popular heating medium of thermal recording apparatuses.

In addition, the heat resistant layer of the recording material of the present invention enables an n-fold speed mode multiple recording apparatus to possess the following advantages over the use of a conventional recording material having a conventional heat resistant layer:

(1) high speed recording;

(2) high tolerance of feeding path of the recording material against a thermal printhead;

(3) high-n-fold recording; and (4) continuous recording for a long period of time.

Due to these advantages, an n-fold speed mode sublimation thermal transfer recording apparatus can be produced as easily as a normal sublimation thermal transfer recording apparatus.

Further, the recording material of the present invention having a substrate of an aromatic polyamide film can be printed at a relatively low feeding speed relative to an image receiving material, namely at high-n-fold speed mode multiple recording.

Furthermore, the recording material of the present invention is available for not only an n-fold speed mode sublimation recording method but also for a normal sublimation recording method.

A better understanding of the present invention may be had from the following detailed description in connection with the accompanying drawings.

Figure 1:
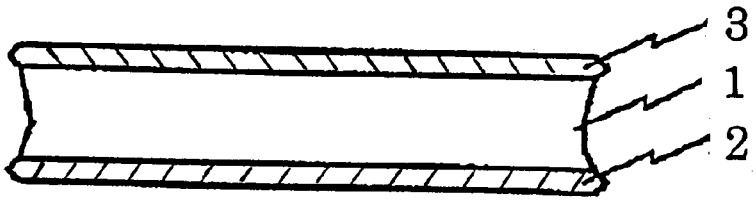
FIG. 1 shows a sectional view of a sublimation thermal transfer recording material including one embodiment of the present invention.

FIG. 1 illustrates a preferred embodiment of the present invention. Reference numerals 1, 2 and 3 designate a substrate, an ink layer and a heat resistant layer, respectively.

Figure 2:
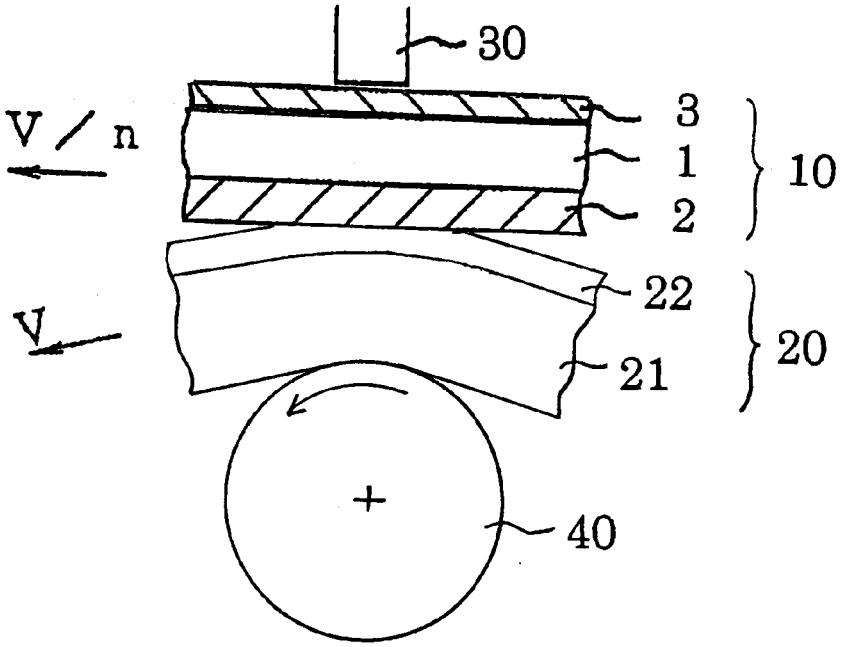
FIG. 2 is a front schematic view showing a printing section of a sublimation thermal transfer recording apparatus using n-fold speed mode multiple recording method.

FIG. 2 illustrates a front schematic view of a printing section of a sublimation thermal transfer recording apparatus using n-fold speed mode multiple recording method which is useful for the recording material of the present invention. Reference numerals 10, 20, 30 and 40 designate a sublimation thermal transfer recording material, a receiving material, a thermal printhead and a platen roll, respectively. Reference numerals 21 and 22 designate a substrate and a dye receiving layer. FIG. 2 shows that the recording material feeds at a velocity of V/n, while the receiving material feeds at a velocity of V.

Suitable materials which may be employed as a substrate 1 in the present invention include-heat resistant films such as, polyester, polysulfone, polystyrene, polyamide, polyacrylate and polyethylene naphthalate. In n-fold speed mode multiple printing, an aromatic polyamide film is preferably employed with respect to heat resistance and film strength. The preferable thickness of the substrate 1 is from 0.5 to 20 $\mu$m, and more preferably from 3 to 10 $\mu$m.

An ink layer 2 includes a sublimable dye and a binder resin. Suitable dyes for use in the ink layer 2 of the present invention are known dyes which sublimate or vaporize at 60° C. or more such as, sublimable disperse dyes and oil-soluble dyes.

Specific examples of useful sublimable dyes are as follows:

C.I. Disperse Yellows 1, 3, 8, 9, 16, 41, 54, 60, 77 and 116;

C.I. Disperse Reds 1, 4, 6, 11, 15, 17, 55, 59, 60, 73 and 83;

C.I. Disperse Blues 3, 14, 19, 26, 56, 60, 64, 72, 99 and 108;

C.I. Solvent Yellows 77 and 116;

C.I. Solvent Reds 23, 25 and 27; and

C.I. Solvent Blues 36, 83 and 105.

These sublimation dyes are employed individually or in combination.

Suitable binder resins for use in the ink layer 2 of the present invention include a thermoplastic resin or a thermosetting resin having a relatively high glass transition temperature Tg or a relatively high softening point.

Specific examples of the binder resin are as follows:

polyvinyl chloride, polyvinyl acetate, polyamide, polyethylene, polycarbonate, polystyrene, polypropylene, acrylic resins, phenolic resins, polyester, polyurethane, epoxy resins, silicone resins, fluorine-contained resins, butyral resins, melamine resins, natural rubber, synthetic rubber, polyvinyl alcohol and cellulose resins.

These resins are employed individually or in combination, and their copolymers can also be employed.

The method of forming an ink layer 2 on a substrate 1 is, for example, as follows:

(a) dispersing or dissolving a sublimable dye, a binder resin and, if desired, an auxiliary agent in a solvent to prepare an ink layer coating liquid, and (b) coating the ink layer coating liquid on a substrate 1 and drying the coated liquid to form an ink layer 2 using a coating machine such as a gravure coating machine and the like.

If desired, an intermediate layer may be formed between a substrate 1 and an ink layer 2, and formation of two or more overlaid ink layers may also be available.

The heat resistant layer 3 preferably has a softening point of at least 200° C. measured by a method based on JIS-K7196 in order to prevent the recording material from sticking to a thermal printhead. The sticking generates residue on the thermal printhead causing an undesired white streak image. The softening point of the heat resistant layer may be changed by manufacturing conditions even when using the same materials and the same formulation for the coating liquid. Therefore, the formulation of the coating liquid and the manufacturing conditions, for example, the preparation of the coating liquid and the formation of the heat resistant layer such as coating, drying and crosslinking, have to be closely controlled to maintain a high softening point.

Suitable materials which may be employed as a resin for the heat resistant layer include crosslinkable silicone modified resins, which are crosslinked by a crosslinking agent to form an excellent heat resistant layer. Specific examples of the resins include crosslinkable silicone modified versions of, for example, polyvinyl butyral resins, epoxy resins, polyester resins, polyurethane resins, acrylic resins, melamine resins and polyvinyl chloride resins. Among these resins, the preferable resin is a crosslinkable silicone-grafted polymer, and the most preferable resin is a combination of a crosslinkable silicone-grafted polymer and an isocyanate compound. Examples of the combination of a crosslinkable silicone-grafted polymer and an isocyanate compound are Daiaromer SP3023, SP2105, SP711 and SP712 which are manufactured and marketed by Dainichiseika Color & Chemical Mgf. Co., Ltd.

Suitable isocyanate compounds which may be employed in the heat resistant layer 3 of the present invention include, for example, tolylene diisocyanate, 4,4-diphenylmethane diisocyanate, xylylene diisocyanate, 1,3-bis (isocyanatomethyl)cyclohexane, hexamethylene diisocyanate, tetramethyl xylylene diisocyanate, and m-isopropenyl-$\alpha$,$\alpha$-dimethylbenzylisocyanate. Adducts of, for example, trimethylol propane with these isocyanate compounds, and trimers of an isocyanate compound can also be employed for the purpose. Among these isocyanate compounds, a trimer of tolylene diisocyanate is most preferable with respect to avoiding contamination to a thermal printhead.

Suitable solvents which may be employed in the heat resistant layer coating liquid of the present invention include solvents which dissolve the resin and the crosslinking agent used for the heat resistant layer 3 and does not react with the reaction product of the resin and the crosslinking agent. Specific examples of solvents are methyl ethyl ketone, ethyl acetate, acetone and toluene.

In addition, a filler which has been used in conventional heat resistant layers to improve heat resistance by reducing contact areas of the heat resistant layer 3 to a thermal printhead may be employed in the heat resistant layer 3 of the present invention. However, since it has excellent heat resistance, the heat resistant layer 3 of the present invention need not include a filler, which tends to generate undesirable white spots in a printed image.

A method of forming a heat resistant layer 3 of the present invention is as follows but is not limited to:

(a) dispersing or dissolving an above-mentioned crosslinkable silicone modified resin and an isocyanate compound in a solvent to prepare a heat resistant layer coating liquid;

(b) coating the coating liquid on a substrate by a coating machine such as a gravure coating machine and the like, and drying to form a heat resistant layer 3; and (c) if desired, heating the coated heat resistant layer to crosslink the silicone modified resin and the isocyanate compound.

The preferable content of the isocyanate compound in the heat resistant layer 3 of the present invention is from 1/10 to 3/1, and more preferably from 1/2 to 2/1, in molar ratio of the amount of active hydrogen atoms of the crosslinkable resin to the amount of isocyanate groups of the isocyanate compound.

The preferable thickness of the heat resistant layer 3 is from 0.1 to 10 μm, and more preferably from 0.5 to 1.0 μm.

Having generally described this invention, a further understanding can be obtained by reference to certain specific examples which are provided herein for purpose of illustration only and are not intended to be limiting unless specified. In the descriptions in the following examples, numbers are weight ratios unless otherwise specified.

EXAMPLES

Example 1

Preparation of a Thermal Transfer Recording Material Formulation of a Heat Resistant Layer:

The following compounds were mixed and coated on one side of an aromatic polyamide film of 6 μm thick (TX1, manufactured by Toray Industries, Inc.) with a wire bar and dried to form a heat resistant layer having a thickness of 0.8 μm on a dry basis. The coated film was heated at 60° C. for 24 hours to crosslink the heat resistant layer.

| | |
|---|---|
| silicone modified resin (Daiaromer SP712, manufactured by Dainichiseika Color & Chemical Mfg. Co., Ltd.) | 30 |
| isocyanate compound (an adduct of trimethylol propane with tolylene diisocyanate, D103H, manufactured by Takeda Chemical Industries, Inc.) | 3 |
| methyl ethyl ketone | 40 |
| toluene | 30 |

Formation of an Ink Layer:

The following compounds were mixed to prepare a Liquid A, a Liquid B and a Liquid C. The Liquid A was coated on the non-layered side of the previously prepared aromatic polyamide film having a heat resistant layer with and dried to form the first ink layer of 4 μm thick, and thereon the Liquid B and the Liquid C were also coated and dried one by one in that order to form the second and the third ink layer of 2 μm and 1 μm thick, respectively. After the formation of these ink layers, the recording material was heated at 60° C. for 24 hours to crosslink the ink layers. Thus, a sublimation thermal transfer recording material was obtained.

| | |
|---|---|
| (Liquid A) | |
| polyvinyl butyral (BX-1, manufactured by Sekisui Chemical Co.) | 7 |
| diisocyanate compound (Coronate L, manufactured by Nippon Polyurethane Industry Co. Ltd.) | 3 |
| polyethylene oxide (R-400, manufactured by Meisei Chemical Works, Ltd.) | 3 |
| sublimable dye (MS CYAN VP, manufactured by Mitsui Toatsu Dye Chemical Inc.) | 30 |
| ethanol | 170 |
| butanol | 20 |
| (Liquid B) | |
| polyvinyl butyral (BX-1) | 10 |
| diisocyanate compound (Coronate L) | 3 |
| sublimable dye (MS CYAN VP) | 20 |
| toluene | 57 |

-continued

| | |
|---|---|
| methyl ethyl ketone | 57 |
| dioxane | 76 |
| (Liquid C) | |
| styrene-maleic acid copolymer (Suprapal AP30, manufactured by BASF Ltd.) | 5 |
| Liquid G | 12 |
| sublimable dye (MS CYAN VP) | 5 |
| tetrahydrofuran | 20 |
| (Liquid G) | |

The following compounds were mixed and then hydrolyzed with addition of 13 parts of 3% sulfuric acid to prepare a Liquid G.

| | |
|---|---|
| dimethyl methoxy silane | 15 |
| methyl trimethoxy silane | 9 |
| methyl ethyl ketone | 12 |

Example 2

The procedure for preparation of the sublimation thermal transfer recording material in Example 1 was repeated except that the formulation of the heat resistant layer was replaced by the following formulation.

| | |
|---|---|
| silicone modified resin (Daiaromer SP725) | 30 |
| isocyanate compound (D103H) | 3 |
| methyl ethyl ketone | 40 |
| toluene | 30 |

Example 3

The procedure for preparation of the sublimation thermal transfer recording material in Example 1 was repeated except that the formulation of the heat resistant layer was replaced by the following formulation.

| | |
|---|---|
| silicone modified resin (Daiaromer SP712) | 30 |
| isocyanate compound (trimer of tolylene diisocyanate, D218, manufactured by Takeda Chemical Industries, Ltd.) | 3 |
| methyl ethyl ketone | 40 |
| toluene | 30 |

Example 4

The procedure for preparation of the sublimation thermal transfer recording material in Example 1 was repeated except that the substrate was replaced by a polyethylene terephthalate film of 6 μm thick manufactured by Diafoil Co., Ltd.

Example 5

The procedure for preparation of the sublimation thermal transfer recording material in Example 1 was repeated except that the formulation of the heat resistant layer was replaced by the following formulation.

| | |
|---|---|
| polyvinyl butyral (BX-1) | 3.6 |
| isocyanate compound (D750, manufactured by | 8.4 |

-continued

| | |
|---|---|
| Dainippon Ink and Chemicals, Inc.) | |
| phosphoric acid ester type surfactant (Plysurf A208S, manufactured by Dai-ichi Kogyo Seiyaku Co., Ltd.) | 2.8 |
| talc (Micro Ace P-3, manufactured by Nippon Talc Co., Ltd.) | 0.6 |
| toluene | 85 |
| methyl ethyl ketone | 85 |

Comparative Example 1

The procedure for preparation of the sublimation thermal transfer recording material in Example 1 was repeated except that the formulation of the heat resistant layer was replaced by the following formulation.

| | |
|---|---|
| silicone modified resin (Daiaromer SP712) | 30 |
| methyl ethyl ketone | 40 |
| toluene | 30 |

Comparative Example 2

The procedure for preparation of the sublimation thermal transfer recording material in Example 1 was repeated except that the formulation of the heat resistant layer was replaced by the following formulation.

| | |
|---|---|
| polyvinyl butyral (BX-1) | 3.6 |
| phosphoric acid ester type surfactant (Plysurf A208S, manufactured by Dai-ichi Kogyo Seiyaku Co., Ltd.) | 2.8 |
| talc (Micro Ace P-3, manufactured by Nippon Talc Co., Ltd.) | 0.6 |
| toluene | 85 |
| methyl ethyl ketone | 85 |

Preparation of an Image Receiving Material

The following coating liquid was prepared, coated on a substrate of a synthetic paper sheet of 150 μm thick (Yupo p-150, manufactured by Oji-Yuka Synthetic Paper,Co., Ltd.) by means of a wire bar, and dried by hot air to form a dye receiving layer of 5 μm thick. Then the coated sheet was heated at 60° C. for 24 hours to prepare an image receiving material having a dye receiving layer.

| | |
|---|---|
| vinyl chloride/vinyl acetate/vinyl alcohol copolymer (VAGH, manufactured by Union Carbide Corp.) | 10 |
| diisocyanate compound | 5 |
| epoxy modified silicone oil (SF8411, by Dow Corning Toray Silicone Co., Ltd.) | 2 |
| toluene | 20 |
| methyl ethyl ketone | 60 |

Methods of Evaluating the Sublimation Thermal Transfer Recording Material (1) Printing test for evaluation of feeding property and image qualities Each of the sublimation thermal transfer recording materials obtained in Examples 1 to 5 and Comparative Examples 1 to 2 was subjected to a printing test. An image was formed on the above-mentioned image receiving sheet by a printing apparatus whose conditions were as follows:

Thermal printhead: A thermal printhead having a dot density of 12 dots/mm.

Feeding speed of the receiving material: 8.4 mm/s.

Feeding speed of the sublimation thermal transfer recording materials: The feeding speed ratio of the recording material to the receiving material was changed from 1/20 to 1/1.

The feeding property of the sublimation thermal recording material was observed visually, and the evenness of the printed image and the residue on the thermal printhead which were caused by sticking of the recording sheet to the thermal printhead were also observed visually. Further, the presence of undesirable white spots were observed which was caused by the rough surface of the heat resistant layer.

(2) Measurements of the softening point of the heat resistant layer

Measurements of the softening point were carried out by the method based on JIS-K7196 under the conditions which follow:

Apparatus: TMA2940 (manufactured by TA Instruments Inc.).

Diameter of a needle: 1 mm.

Load: 0.49 N.

The results are shown in Table 1.

TABLE 1

| | Feeding property* | printing qualities of the image | Residue on the printhead | Softening point of the heat resistance layer (° C.) |
|---|---|---|---|---|
| Example 1 | ○ | good | trace | 311 |
| Example 2 | ◎ | good | trace | 293 |
| Example 3 | ○ | good | none | 320 |
| Example 4 | Δ | good | trace | 310 |
| Example 5 | ○ | white spots image were observed | trace | 280 |
| Comparative Example 1 | X | good | abundant | 107 |
| Comparative Example 2 | ○ | white spots image were observed | abundant | 111 |

*◎: The recording material is printable without problems at a feeding speed ratio of between 1/20 and 1/1 to the receiving material.
○: The recording material is printable without problems at a feeding speed ratio of between 1/15 and 1/1 to the receiving material.
Δ: The recording material is printable at a feeding speed ratio of between 1/15 and 1/1 to the receiving material but is extended in the feeding direction during the printing at a feeding speed ratio of between 1/15 and 1/3 to the receiving material.
X: The recording material is printable only at a feeding speed ratio between 1/3 and 1/1 to the receiving material.

The results in Table 1 clearly indicate that the sublimation thermal transfer recording materials of the present invention, particularly the recording material obtained in Examples 1 to 3, exhibit such characteristics as excellent feeding property, excellent image quality without the presence of undesirable white spot images, and without contamination to the thermal printhead.

The results in Table 1 also indicate that the heat resistant layers of the recording materials obtained in Comparative Examples 1 and 2 have low softening points which result in the generation of a large amount of residue on the thermal printhead, and that the heat resistant layers of the recording materials obtained in Example 5 and Comparative Example 2 generates white spot images which are due to its rough surface caused by a filler.

In addition, the results in Table 1 indicate that the substrate, i.e. aromatic polyamide film, of the recording materials obtained in Examples 1, 2, 3 and 5 has excellent heat resistant property which does not generate extension of the recording material even in high-n-fold speed mode multiple recording.

Having now fully described the invention, it will be apparent to one of ordinary skill in the art that many changes and modifications can be made thereto without departing from the spirit or scope of the invention as set forth herein.

This invention is based on Japanese Patent Application 07-279513 filed on Oct. 26, 1995 incorporated herein by reference.

What is claimed as new and desired to be secured by Letters Patent of the United States is:

1. A sublimation thermal transfer recording material comprising a substrate, an ink layer formed on one side of said substrate, and a heat resistant layer formed on the other side of said substrate, wherein said heat resistant layer has a softening point of at least 200° C. measured by a method based on JIS-K7196.

2. The sublimation thermal transfer recording material of claim 1, wherein said heat resistant layer comprises a silicone modified resin.

3. The sublimation thermal transfer recording material of claim 2, wherein said silicone modified resin comprises a reaction product of a silicone-grafted polymer and an isocyanate compound.

4. The sublimation thermal transfer recording material of claim 3, wherein said isocyanate compound comprises a trimer of tolylene diisocyanate.

5. The sublimation thermal transfer recording material of claim 4, wherein said substrate is an aromatic polyamide film.

6. The sublimation thermal transfer recording material of claim 3, wherein said substrate is an aromatic polyamide film.

7. The sublimation thermal transfer recording material of claim 3, wherein the molar ratio of an amount of active hydrogen atoms of said silicone modified resin to an amount of isocyanate groups of said isocyanate compound is from about 1/2 to 2/1.

8. The sublimation thermal transfer recording material of claim 2, wherein said substrate is an aromatic polyamide film.

9. The sublimation thermal transfer recording material of claim 1, wherein said substrate is an aromatic polyamide film.

10. The sublimation thermal transfer recording material of claim 1, wherein the thickness of said substrate is from about 3 to 10 $\mu$m.

11. The sublimation thermal transfer recording material of claim 1, wherein the thickness of said heat resistant layer is from about 0.5 to 1.0 $\mu$m.

12. A sublimation thermal transfer recording method comprising heating imagewise a sublimation thermal transfer recording material comprising a substrate, an ink layer formed on one side of said substrate, and a heat resistant layer formed on the other side of said substrate, from the side of said heat resistant layer to form an image on an image receiving material which contacts said ink layer and is fed at a speed of equal to or faster than that of said sublimation thermal transfer recording material, wherein said heat resistant layer has a softening point of at least 200° C. measured by a method based on JIS-K7196.

13. The sublimation thermal transfer recording method of claim 12, wherein said heat resistant layer comprises a silicone modified resin.

14. The sublimation thermal transfer recording method of claim 13, wherein said silicone modified resin comprises a reaction product of a silicone-grafted polymer and an isocyanate compound.

15. The sublimation thermal transfer recording method of claims 14, wherein said isocyanate compound comprises a trimer of tolylene diisocyanate.

16. The sublimation thermal transfer recording method of claim 15, wherein said substrate is an aromatic polyamide film.

17. The sublimation thermal transfer recording method of claim 14, wherein said substrate is an aromatic polyamide film.

18. The sublimation thermal transfer recording method of claim 14, wherein the molar ratio of an amount of active hydrogen atoms of said silicone modified resin to an amount of isocyanate groups of said isocyanate compound is from about 1/2 to 2/1.

19. The sublimation thermal transfer recording method of claim 4, wherein said substrate is an aromatic polyamide film.

20. The sublimation thermal transfer recording method of claim 12, wherein said substrate is an aromatic polyamide film.

21. The sublimation thermal transfer recording method of claim 12, wherein the thickness of said substrate is from about 3 to 10 $\mu$m.

22. The sublimation thermal transfer recording method of claim 12, wherein the thickness of said heat resistant layer is from about 0.5 to 1.0 $\mu$m.

* * * * *